United States Patent [19]

Hillegonds

[11] Patent Number: 4,911,210

[45] Date of Patent: Mar. 27, 1990

[54] FLAT CABLE POSITIONING TRAY

[75] Inventor: Larry A. Hillegonds, New Lenox, Ill.

[73] Assignee: Panduit Corp., Tinley Park, Ill.

[21] Appl. No.: 271,974

[22] Filed: Nov. 15, 1988

[51] Int. Cl.[4] ..... B21F 1/02

[52] U.S. Cl. ..... 140/147; 29/749

[58] Field of Search ..... 140/147; 29/749, 755

[56] References Cited

U.S. PATENT DOCUMENTS

| | | | |
|---|---|---|---|
| 3,083,743 | 4/1963 | Fick | 140/147 |
| 3,817,127 | 6/1974 | Soeller . | |
| 3,891,013 | 6/1975 | Folk et al. . | |
| 4,125,137 | 11/1978 | Shatto, Jr. . | |
| 4,148,130 | 4/1979 | Stauffer et al. . | |
| 4,393,580 | 7/1983 | Hall, Jr. . | |
| 4,554,733 | 11/1985 | Caveney . | |
| 4,682,391 | 7/1987 | Hall, Jr. et al. | 29/749 |
| 4,744,142 | 5/1988 | Shields | 29/749 |

*Primary Examiner*—Lowell A. Larson

*Attorney, Agent, or Firm*—Charles R. Wentzel; Mark D. Hilliard

[57] ABSTRACT

A cable tray for use with a tool for applying a connector to a multiconductor flat cable includes a planar grooved cable positioning surface that aligns individual conductors of a flat cable and a cable transfer rod removably and rotatably mounted perpendicular to the length of the grooves and spaced from a cable positioned on the grooves of the positioning surface an amount sufficient to engage the surface of a cable inserted therebetween and upon rotation of the rod accurately advance the terminal edge of the cable to a desired termination position and securely hold the cable in position until a connector is terminated thereto.

5 Claims, 5 Drawing Sheets

FLAT CABLE POSITIONING TRAY

BACKGROUND OF THE INVENTION

The present invention relates generally to tooling for the application of mass termination insulation displacement connectors to flat cable having a plurality of parallel, regularly spaced conductors imbedded within an initially planar sheet of insulation. More specifically, the present invention relates to a cable tray usable with such tooling to flatten, position and hold a section of flat cable for accurate presentation within termination tooling.

It has been known to utilize flat cable trays to initially position planar flat cables for accurate presentation of the flat cable to a mass termination connector for application by the termination tooling. A successful termination tool that utilizes a cable tray to support and initially position a planar flat cable for subsequent lateral insertion between the base and cover of a connector for accurate termination of the connector to the flat cable is described in U.S. Pat. No. 4,554,733 owned by common assignee Panduit Corp.

Although the tooling described in the above patent successfully terminates generally planar flat cable, proper termination is inherently dependent upon the operator's manual dexterity in accurate initial positioning of the flat cable relative to the cable tray and the operator's retention of this position as a cable tray is slid into position to be terminated by the tool. Also the tooling is practically incapable of terminating nonplanar termination sections of cables of the round-flat cable type. A Round-flat cable comprises a plurality of parallel insulated conductors alternating along the length of the cable between approximately three centimeter termination sections where adjacent insulated conductors are bonded together to form a flat cable and three centimeter flexible sections of unbonded conductors. The round-flat cable is rolled into a roughly tubular shape and encased within a tubular insulative sheath. Termination of round-flat cable is accomplished by removing a preferably short, approximately 4½ centimeter, section of the tubular insulative sheath, flattening the non-planar termination section of the cable back to its original planar disposition, positioning, aligning and holding the flattened termination section of the cable on the cable tray in such a manner as to retain the section in its flattened, and aligned disposition on the tray until a connector has been applied thereto. Accurate alignment of a round-flat cable for termination within the prior tooling is made extremely difficult by the limited length of the flattened termination section available to align with the edge of the tray, the typical length of the termination section only being three centimeters, which is a small percentage of the length of the edge of the prior tray available for alignment with the edge of the flattened cable. It has been found that it is extremely difficult, if not practically impossible, to consistently hold the short, non-planar, round-flat cable by hand on the cable tray in an accurately aligned, planar disposition for successful termination within the tooling.

SUMMARY OF THE INVENTION

Among the objects of the present invention may be noted the provision of an improved cable tray that requires less operator dexterity to accurately align the cable within the cable tray and does not require any operator dexterity to hold the cable in an aligned position until subsequent termination of a connector to the cable and the provision of an improved cable tray that can accurately position and hold short lengths of non-planar cable until subsequent termination of a connector to the cable.

In general, a cable tray for positioning a multiconductor cable in a connector application tool includes planar positioning means for accurately laterally positioning the multiconductor cable; cable tray positioning means for positioning the cable tray relative to the connector application tool; and rod means for advancing the multiconductor cable in a direction parallel to the axis of the conductors of the multiconductor cable, the rod means being rotatably mounted substantially perpendicular to the direction of advancement of the cable, substantially parallel to the planar positioning means and being disposed spaced from the planar positioning means an amount sufficient to accept the thickness of the cable and engage the surface of the cable with the rod means, whereby rotation of the rod means accurately advances and positions a terminal edge of a cable inserted between the rod means and the planar positioning means and holds the cable in position during subsequent translation of the cable tray.

DESCRIPTION OF THE PREFERRED EMBODIMENT

Figure 1:
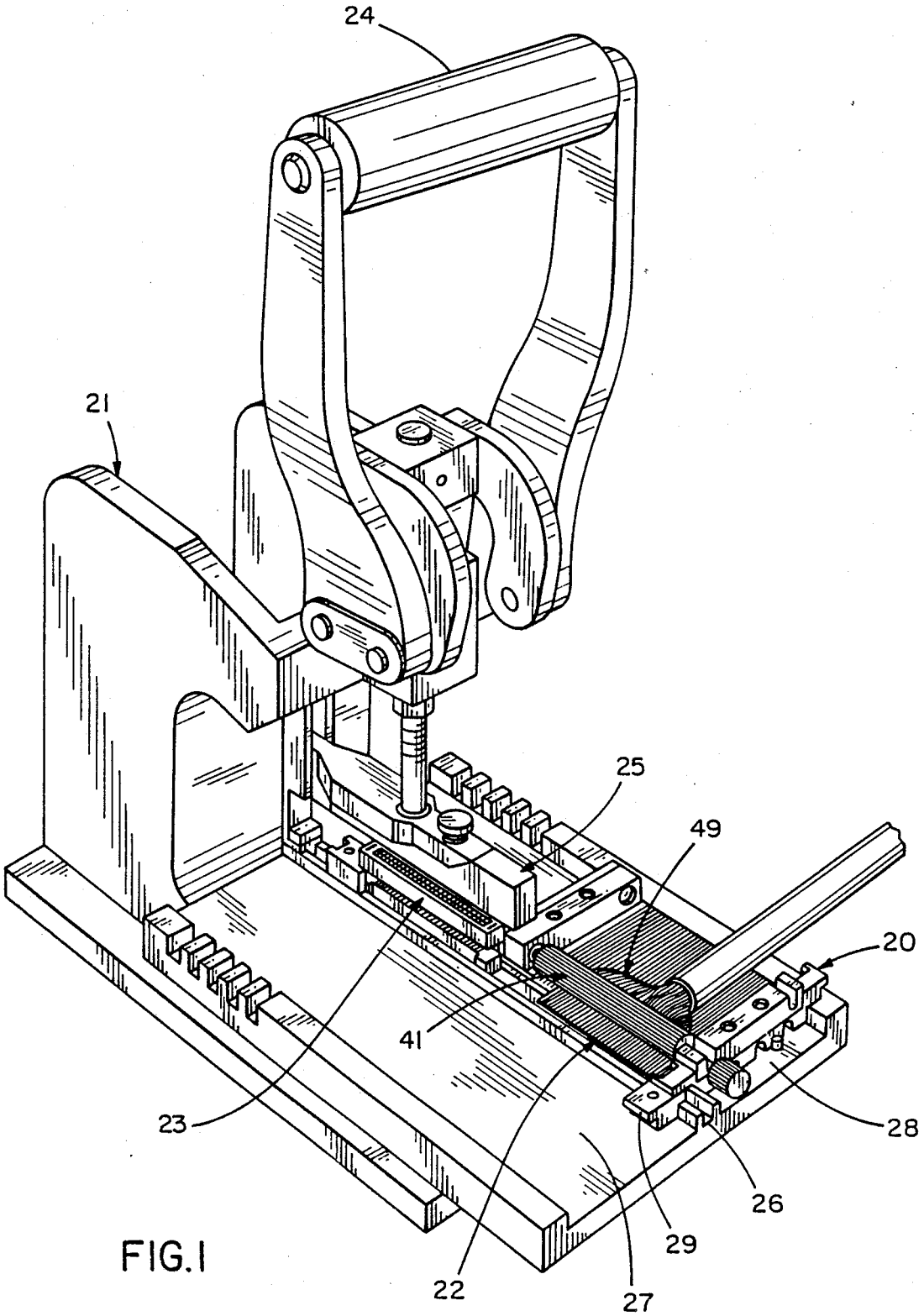
FIG. 1 is a perspective view of termination tooling utilizing a cable tray embodying concept of the present invention.
Figure 2:
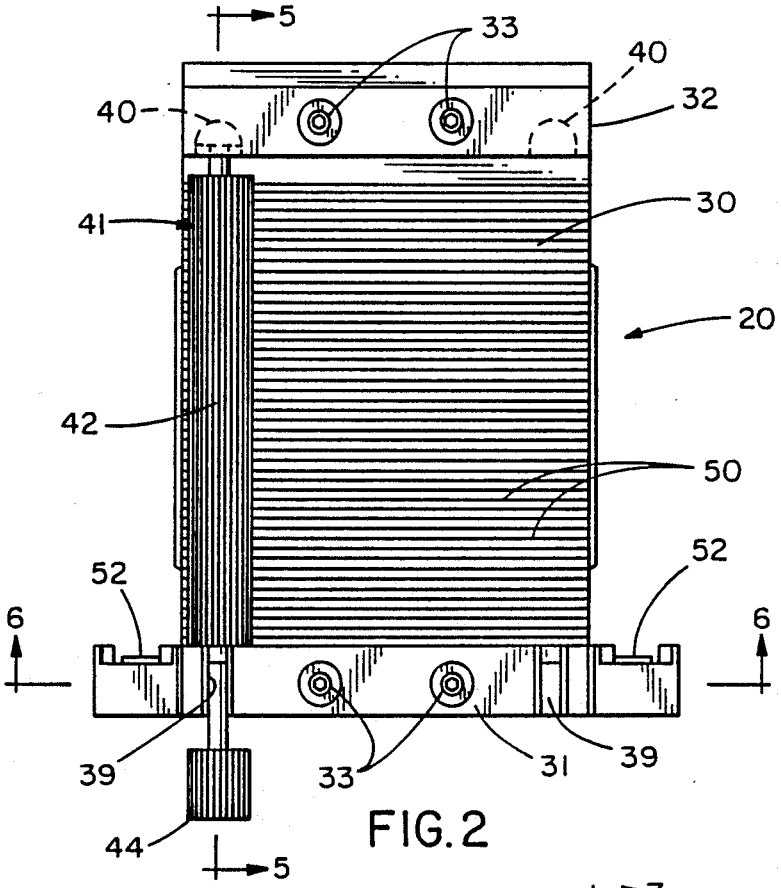
FIG. 2 is a plan view of the cable tray of FIG. 1.

A cable tray embodying the concept of the present invention is designated by the numeral 20 in the accompanying drawings. Cable tray 20 is slidably mounted within manual press 21 of FIG. 1 to present a flat cable 22 for termination within a connector 23 in a manner identical to that described in detail in U.S. Pat. No. 4,554,733 to Caveney owned by common assignee, Panduit Corp., which is incorporated herein by reference.

Manual press 21 includes a pivotally mounted handle 24 that strokes a termination die 25 downwardly to compress and terminate connector 23 to a cable located therebetween. Press 21 includes a centrally located connector positioning channel 26 aligned with die 25 and left and right cable tray channels 27 and 28 that allow selective positioning of cable tray 20 for either left- or right-handed operation. A cable stop 29 is positioned to accurately align the distal edge of a cable positioned on the cable tray relative to connector positioning channel 26 and thus with reference to connector 23 carried therein.

Figure 4:
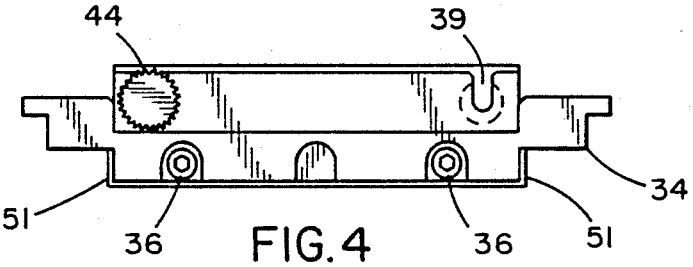
FIG. 4 is a front elevation of the cable tie of FIG. 2.
Figure 5:
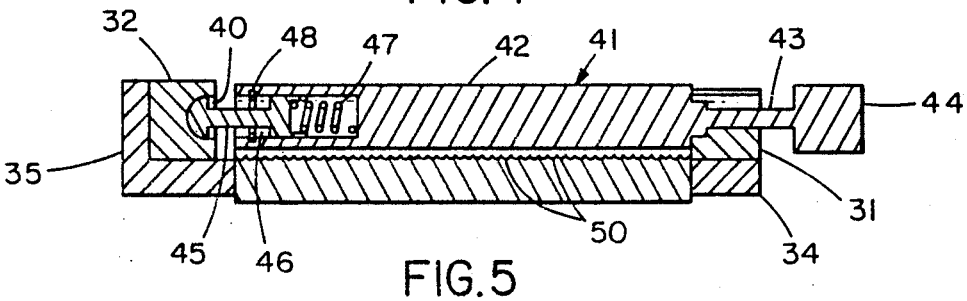
FIG. 5 is a sectional view taken along line 5—5 of FIG. 2.
Figure 6:
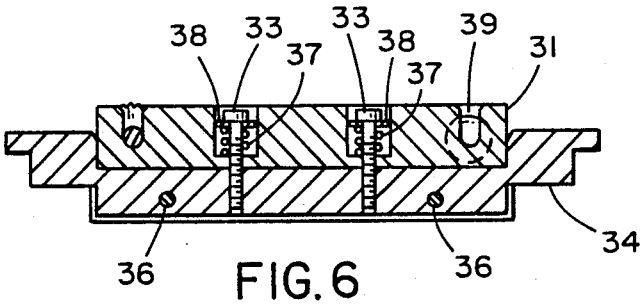
FIG. 6 is a sectional view taken along line 6—6 of FIG. 2.
Figure 7:
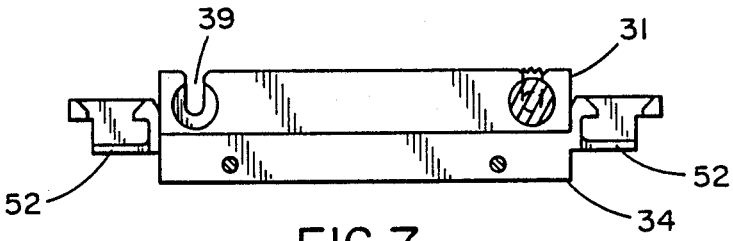
FIG. 7 is a sectional view taken along line 7—7 of FIG. 3.

As seen in FIGS. 2–7 cable tray 20 includes a generally planar rectangular cable positioning surface 30 having disposed at forward and rearward edges front and back rod mounting guides 31 and 32 resiliently mounted by bolts 33 to front and back guide mounting members 34 and 35 which are fastened to the edge of cable positioning surface 30 by bolts 36. As best seen in FIG. 6, springs 37 mounted on bolts 33 resiliently bias front and back guides 31 and 32 downwardly towards surface 30 by acting against washers 38 carried by bolts 33. Cable tray 20 is symmetrical about its front to back center line; cable tray 20 being capable of being used in either left or right cable tray channels 27 or 28 to effect right- or left-handed operation of press 21.

Respectively located adjacent opposing ends of guides 31 and 32 are pairs of opposed cable transfer rod mounting slots 39 and sockets 40. Each opposed slot and socket pair are disposed to removably mount cable transfer rod 41 to allow easy conversion of cable tray 20 to either left- or right-handed operation, the cable tray 20 depicted in the drawings being configured for right-handed operation.

Figure 3:
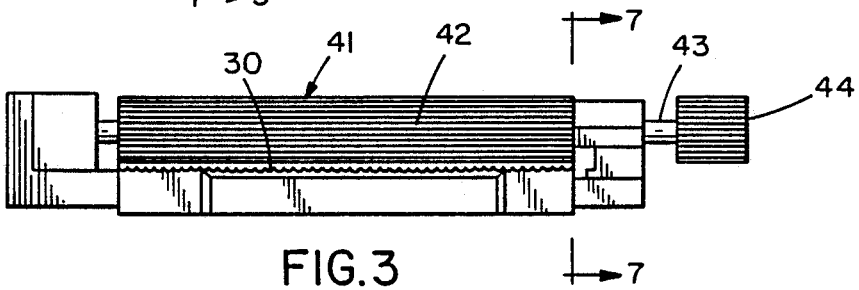
FIG. 3 is a side elevation of the cable tray of FIG. 2.

Cable transfer rod 41, as best seen in FIGS. 3–5, includes a diamond knurled, cylindrical cable engaging portion 42, an axle portion 43 projecting from a first end terminating in a knob portion 44. A foot 45 is mounted within a bore 46 in the opposite end of rod 41 and is biased outwardly by spring 47 against a retainer 48. Foot 45 terminates in a hemispherical end portion that is dimensioned to be received within socket 40.

Cable transfer rod 41 is mounted within an opposed socket 40 and slot 39 by grasping knob portion 44, inserting the end of foot portion 45 into socket 40, pushing rod 41 inwardly to compress spring 47 and inserting axle portion 43 into slot 39. Rod 41 is mounted so as to present the knurled surface of cable engaging portion 42 spaced from cable positioning surface 30 an amount less than the thickness of a flat cable 49 to be terminated; resiliently mounted guides 31 and 32, resiliently biasing rod 41 into engagement with the cable and allowing rod 41 to move away from surface 30 an amount sufficient to accept the thickness of the cable. Rod 41 is mounted with the axis of its cylindrical cable engaging portion 42 disposed parallel to cable engaging surface 30. Cable positioning surface 30 includes a plurality of parallel conductor positioning grooves 50 disposed perpendicular to cable transfer rod 41 and dimensioned to receive and align individual conductors of flat cable 49.

In preferred form cable tray 20 includes alignment edges 51 that are disposed to slidably engage respective edges of channels 27 or 28 to allow accurate, aligned translation of tray 20 from an outward cable insertion position shown in FIG. 1 to an inward cable termination position located adjacent termination die 25. Connector positioning slots 52 are formed at opposite ends of flange 31 projecting outwardly of surface 30 in alignment with connector positioning channel 26.

Figure 8:
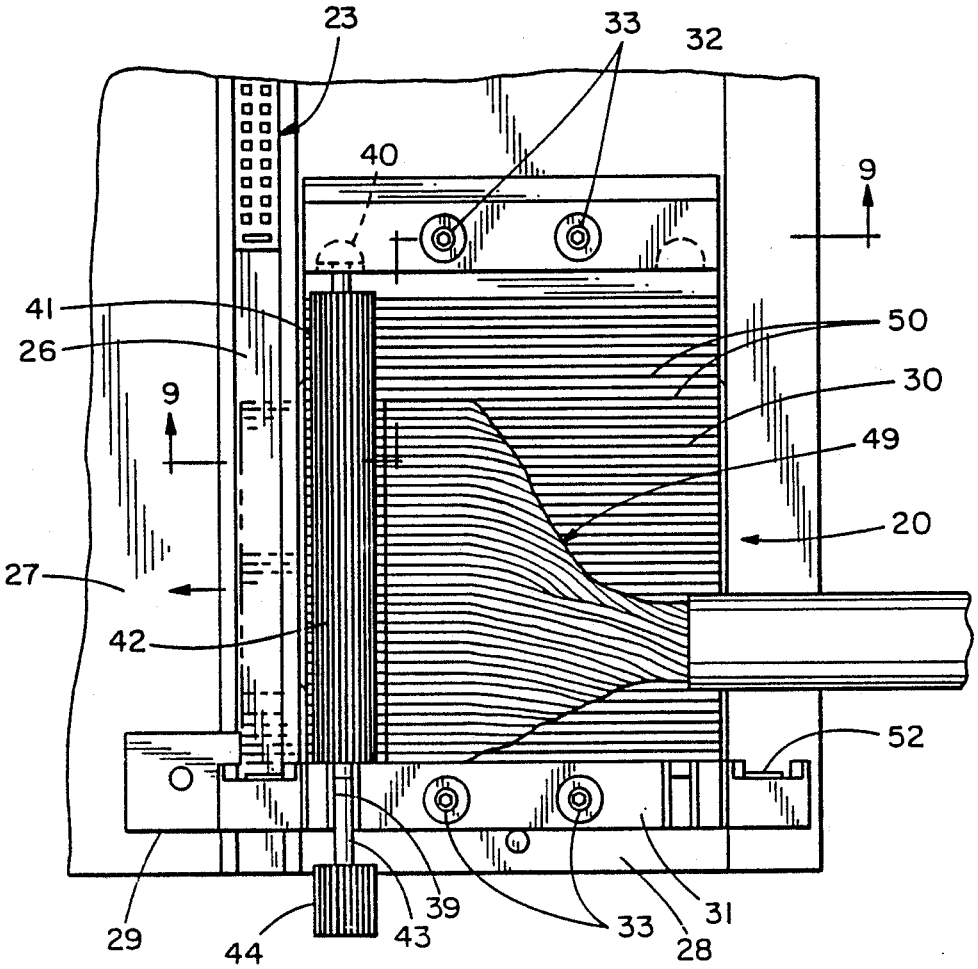
FIG. 8 is a partial plan view of the tooling of FIG. 1 showing the position of the cable on the cable tray just prior to insertion of the edge of the cable beneath cable transfer rod and showing in phantom the position of the cable aligned against the cable aligning cable stop.
Figure 9:
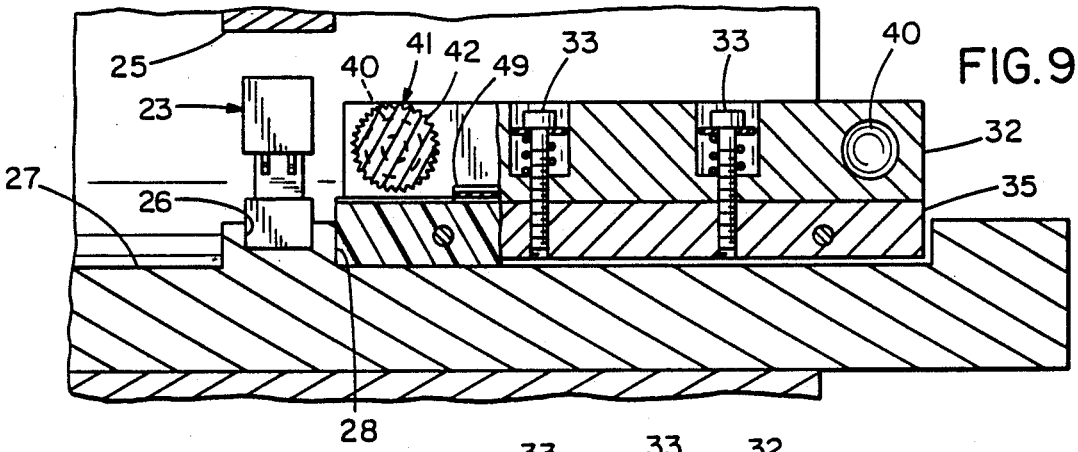
FIG. 9 is a sectional view taken along line 9—9 of FIG. 8.
Figure 10:
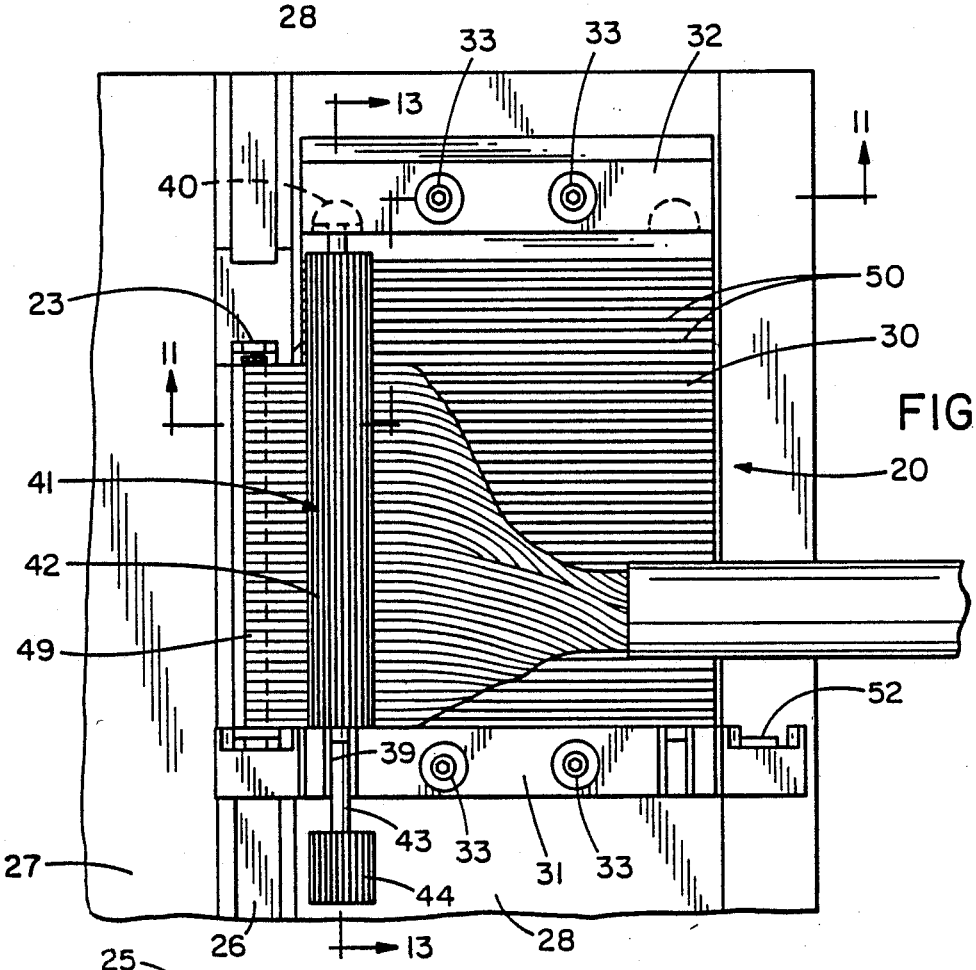
FIG. 10 is the view of FIG. 8 showing the cable positioned for termination between the connector.
Figure 11:
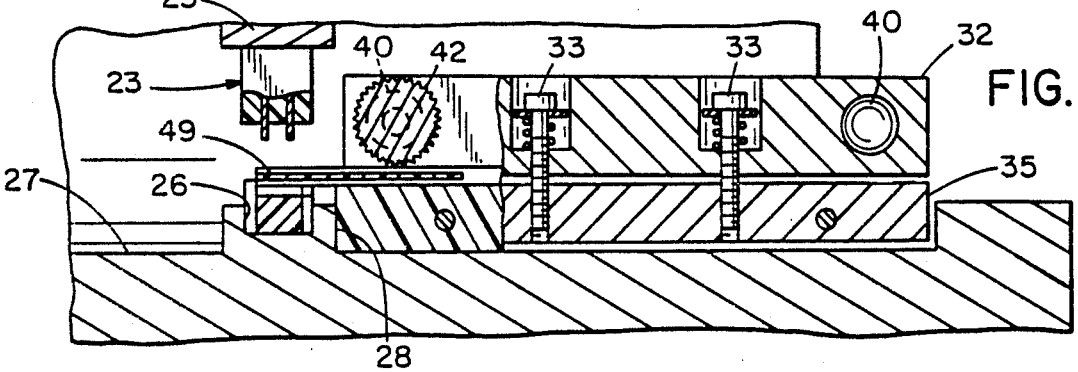
FIG. 11 is a sectional view taken along line 11—11 of FIG. 10.
Figure 12:
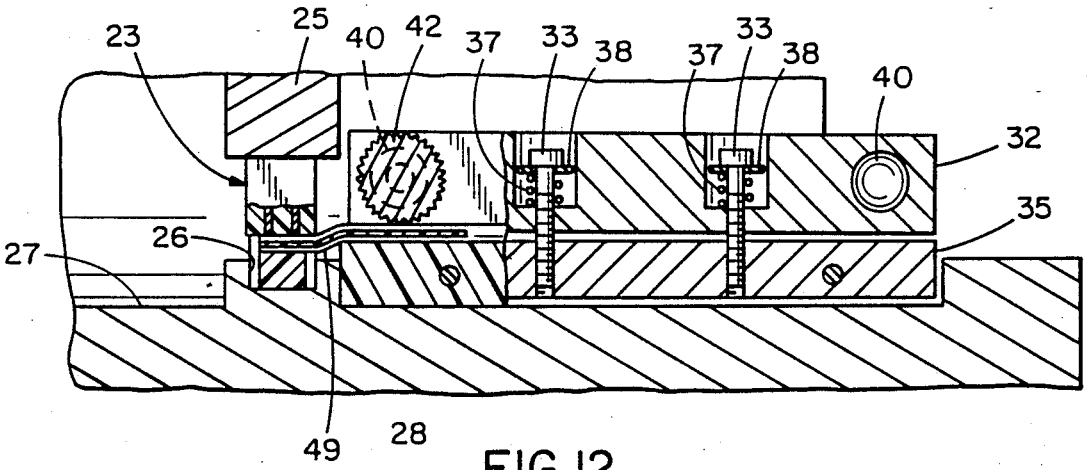
FIG. 12 is a sectional view taken line 11—11 of FIG. 10 showing the connector terminated to the cable.
Figure 13:
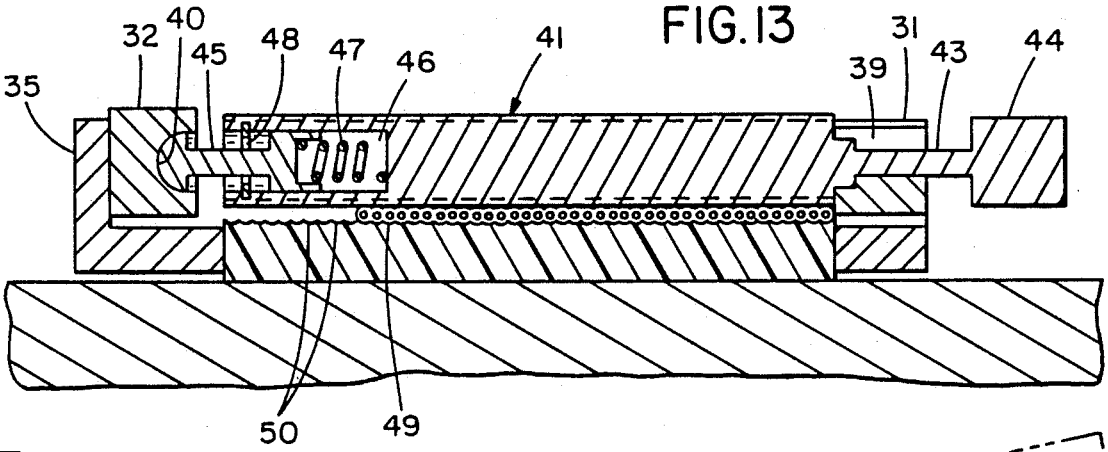
FIG. 13 is a sectional view taken line 13—13 of FIG. 10.
Figure 14:
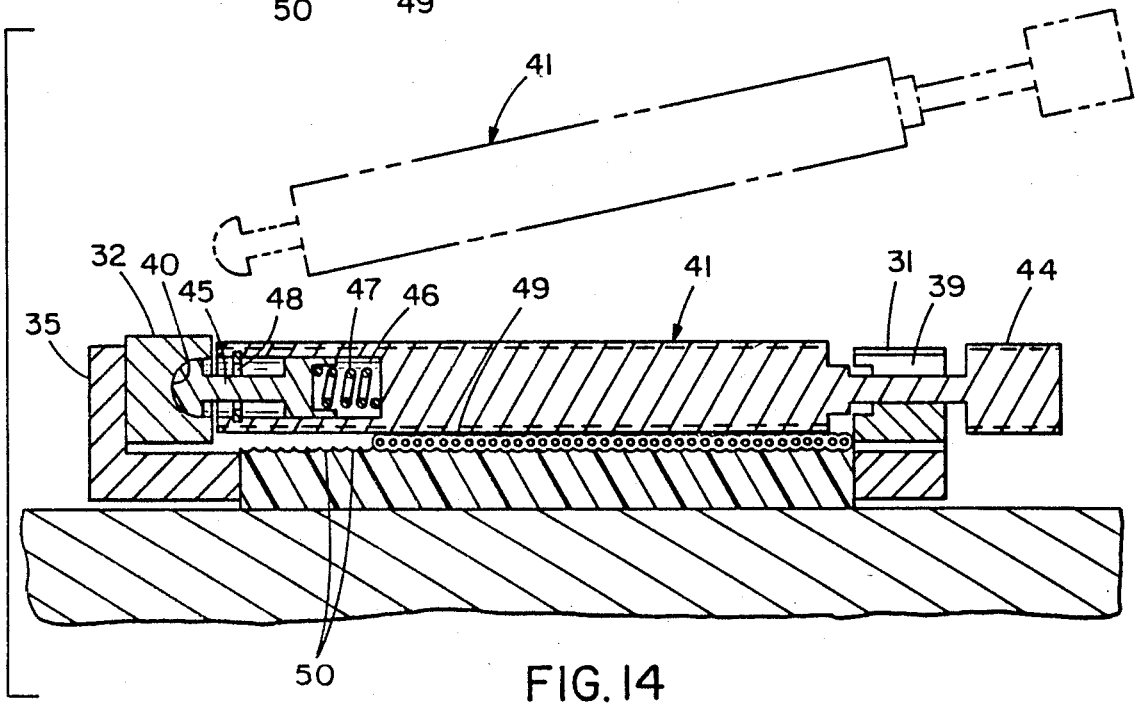
FIG. 14 is the sectional view of FIG. 13 showing the removable cable transfer rod and phantom.

In operation as depicted in FIGS. 8–12, an operator aligns a lateral edge of flat cable 49 with an inner edge of front rod mounting flange 31, which axially aligns individual conductors of flat cable 49 with grooves 50, inserts a terminal edge of flat cable 49 underneath cable transfer rod 41 and turns knob portion 44 clockwise to rotate rod 41, the knurled surface of cable engaging portion 42 of resiliently mounted rod 41 engaging the upper surface of flat cable 49 to drive flat cable 49 in the direction of the arrow in FIG. 8, towards and into abutment with cable stop 29, as shown in phantom in FIG. 8, to position the terminal portion of flat cable 49 for subsequent termination to connector 23 as seen in FIGS. 10–12.

I claim:

1. A cable tray for positioning a multiconductor cable in a connector application tool, comprising:
   planar positioning means for accurately laterally positioning the multiconductor cable;
   cable tray positioning means for positioning the cable tray relative to the connector application tool; and
   rod means for advancing the multiconductor cable in a direction parallel to the axis of the conductors of the multiconductor cable, the rod means being rotatably mounted substantially perpendicular to the direction of advancement of the cable, substantially parallel to the planar positioning means and being disposed spaced from the planar positioning means an amount sufficient to accept the thickness of the cable and engage the surface of the cable with the rod means, whereby rotation of the rod means accurately advances and positions a terminal edge of a cable inserted between the rod means and the planar positioning means and holds the cable in position during subsequent translation of the cable tray.

2. A cable tray as set forth in claim 1, wherein the rod means is resiliently mounted to and spaced from the planar positioning means an amount sufficient to resiliently engage a cable inserted between the rod means and the planar positioning means.

3. A cable tray as set forth in claim 2, wherein the planar positioning means includes a plurality of parallel grooves disposed to accept and laterally align individual conductors of the multiconductor cable and wherein the rod means includes a knurled, cylindrical cable engaging surface portion.

4. A cable tray as set forth in claim 3, including two position mounting means for removably mounting the rod means in either a left-hand operation position or a right-hand operation position.

5. A cable tray as set forth in claim 4, wherein the two position mounting means includes a transfer rod having a resiliently mounted foot and an axle portion disposed at opposite ends of the cylindrical cable engaging portion of the rod means, and first and second pair of a slot and a bore, each slot and bore respectively being formed adjacent front and back edges of the planar positioning means in aligned and opposed disposition; each of the first and second slot and bore pairs being respectively disposed adjacent first and second edges of the planar positioning means whereby the rod means can be removably mounted in either of the first or second slot and bore pairs.

* * * * *